United States Patent [19]

Begg et al.

[11] Patent Number: 4,749,545

[45] Date of Patent: Jun. 7, 1988

[54] PREPARATION OF COMPOSITES

[75] Inventors: Alan R. Begg, Ascot; Andrew D. Tarrant, Staines, both of England

[73] Assignee: British Petroleum Co. p.l.c., London, England

[21] Appl. No.: 30,239

[22] Filed: Mar. 26, 1987

[30] Foreign Application Priority Data

Apr. 2, 1986 [GB] United Kingdom ..... 8608030

[51] Int. Cl.[4] ..... B22F 1/00

[52] U.S. Cl. ..... 419/13; 75/232; 75/235; 75/236; 75/244; 419/17; 419/19; 419/23; 419/24; 419/32; 419/33; 419/42; 419/49

[58] Field of Search ..... 419/10–22, 419/32, 33, 23, 24, 42, 49; 75/232–244; 428/565

[56] References Cited

U.S. PATENT DOCUMENTS

| | | | |
|---|---|---|---|
| 2,568,157 | 9/1951 | Lepp et al. | 25/157 |
| 2,793,949 | 5/1957 | Imich | 75/135 |
| 2,894,319 | 7/1959 | Thomson | 29/182.5 |
| 3,239,319 | 3/1966 | Pollard | 29/183 |
| 3,725,015 | 4/1973 | Weaver | 29/182.1 |
| 3,828,417 | 8/1974 | Divecha | 29/419 |
| 3,877,884 | 4/1975 | Tawarada et al. | 75/232 |
| 4,012,204 | 3/1977 | Riewald et al. | 75/229 |
| 4,060,412 | 11/1977 | Divecha | 75/203 |
| 4,557,893 | 12/1985 | Jatkar et al. | 419/17 |
| 4,624,705 | 11/1986 | Jatkar et al. | 419/11 |
| 4,664,704 | 5/1987 | Dohndmoto et al. | 75/235 |

FOREIGN PATENT DOCUMENTS 5083207 11/1973 Japan .

*Primary Examiner*—Stephen J. Lechert, Jr.
*Attorney, Agent, or Firm*—Murray and Whisenhunt

[57] ABSTRACT

This invention relates to metal matrix composites containing at least 40% v/v of a hard material such as SiC and a matrix of aluminium, magnesium or alloys of either. The invention also covers a method of making such composites by ball milling powders of the respective components. Other mixing techniques do not enable such a high proportion of hard material to be incorporated into the composite. The composites are useful to produce components resistant to wear.

9 Claims, No Drawings

PREPARATION OF COMPOSITES

The present invention relates to metal matrix composites and to a process for making the same. More specifically, the metal matrix composites produced by the present process comprise aluminum, magnesium or an alloy of either and a hard material such as carbides, nitrides, oxides and borides.

Much work is being conducted on the preparation of metal matrix composites useful in a variety of applications. For example, composites containing carbon, alumina and silica carbide fibres in metal matrixes such as aluminium and Group VIIIA metals (i.e. iron, cobalt, nickel) are being examined.

Of particular interest herein are composites comprising a hard metal or ceramic material in an aluminium or magnesium matrix. Such metal matrix composites are particularly useful in the aerospace and automotive industries where materials exhibiting strength, stiffness and lightweight characteristics are highly desirable.

Conventionally, these types of matrix composites were generally prepared with whiskers or fibres of a hard material such as silicon carbide and powders of a metal matrix material. The whiskers or fibres were used as structural reinforcements within the metal matrix with the integrity and alignment of the whiskers or fibres affecting the properties of the final composite. These composites can have a high modulus of elasticity e.g. up to 310 GPa.

However, in such composites the raw materials e.g. the reinforcing fibres and whiskers are generally expensive, such reinforcements are difficult to process and the properties of such fibre and whisker reinforced composites are anisotropic. Where particulate hard materials have been used as reinforcements, the resultant composites produced hitherto have either low density or high flexural strength but rarely both.

It has now been found that aluminium and magnesium matrix composites can be prepared entirely of powdered or particulate components containing high concentrations of hard materials and which exhibit very high moduli of elasticity. These composites exhibit moduli of elasticity well in excess of 120 GPa, in fact greater than 130 GPa. Moreover, these composites have improved strength and thermal stability.

Accordingly, the present invention is a metal matrix composite comprising at least 40% by volume of a hard material reinforcing a metal matrix comprising aluminium, magnesium or alloys of either, said composite having a stiffness to weight ratio of at least 34 Mm $NKg^{-1}$.

According to another embodiment the present invention provides a method for preparing metal matrix composites comprising at least 40% v/v of a hard material and a lightweight component selected from aluminium, magnesium and alloys of either, the method comprising intimately mixing using a high energy milling technique a powder of the hard material and either aluminium or magnesium in its powder form to produce a uniform powder mixture and compacting the powder mixture at elevated temperatures.

As used herein, the lightweight component can be either a pure aluminium or magnesium metal or an alloy containing at least 70% by weight, preferably 80% by weight and most preferably 90% by weight aluminium or magnesium. Examples of such alloys include aluminium containing manganese, silicon, copper, magnesium, lithium, nickel, chromium or zinc or combinations thereof; or magnesium containing aluminium, zinc, maganese, zirconium, cerium or combinations thereof.

The hard materials useful herein include silicon carbides, nitrides, oxides; boron carbides, nitrides or oxides; metal carbides, nitrides, oxides, or borides; aluminium nitrides or oxides; zirconium oxides; and diamonds. Preferred examples of such materials are silicon carbide, silicon nitride, titanium carbide, boron carbide, titanium nitride, and zirconium oxide.

It is important to note that the composites herein are prepared from powders. Although fibres or whiskers can be present, the hard material should contain less than about 20% by weight of fibres or whiskers. It is preferred that the hard material contain less than 5% by weight of fibres or whiskers.

It is essential to carry out the intimate mixing of the powders by high energy milling. Otherwise, it is not possible to produce composites in which the hard material is present in concentrations above 40% v/v and which composites display high densities of the order of 97% or more of the theoretical density. Moreover, high energy milling achieves excellent mixing of the components and also enables particles of the hard materials to be totally encompassed by the matrix metal. This has not been possible by other mixing methods. Thus when preparing the composites according to this invention, powders of the hard material and aluminium, magnesium or alloys of either are placed in a high energy milling apparatus such as a ball mill, a swing grinding mill (teamer mill) or an attritor mill. It is preferred to use hard material powders having an average particle size of less than 50 microns, most preferably less than 20 microns. The powder of aluminium, magnesium or an alloy of either preferably has an average particle size of less than 100 microns. The milling should continue for a sufficient time to intimately mix the powders and until the powder mixture has a uniform appearance. In a swing grinding mill or an attritor mill imtimate mixing for 2 to 100 minutes has been found adequate depending upon the efficiency of the high energy milling operation.

The powder mix suitably contains the hard material in concentrations from 45% to 80% by volume. Small amounts of binder materials, milling agents or compaction agents can be used to aid processing.

Once the powder mix has been prepared, it is uniformly compacted at elevated temperatures preferably by hot isostatic pressing. Where hot isostatic pressing (hereinafter referred to as "HIP") is used as the compaction technique, it is preferable to degas the system prior to HIP. Degassing may be achieved for instance at a temperature from 520°-660° C., preferably 540°-555° C., and a pressure of $10^{-1}$ to $10^{-8}$ Torr, preferably $10^{-4}$ to $10^{-6}$ Torr for a duration of at least 1 hour e.g. 2 hours. Subsequently the degassed material may be subjected to HIP at a temperature from 500°-560° C. e.g. 550° C. and a pressure of at least 15,000 psi e.g. 30,000 psi for a duration of at least 1 hour e.g. 2 hours.

It has been found that the metal matrix composites produced by the process of the present invention have low porosity levels e.g. below 1% v/v which are not normally achieved by conventional methods. The composites have a flexural strength in excess of 500 MPa in aluminium systems and have densities below 3 g/cc.

The present invention is further illustrated by the following example which is provided only to illustrate one embodiment of this invention. The scope of this invention includes equivalent emodiments, variations and modifications within the spirit of the disclosure.

EXAMPLE 50 g of high purity aluminium powder (average particle size 60 microns) and 80 g of silicon carbide particles (average particle size 3 microns) were together subjected to high energy milling in a Herzog swing grinding mill (type HSM 100) for 15 minutes. A pure aluminium can was filled with the milled powders. Vacuum degassing of the can and contents was carried out at 550° C., $10^{-3}$ torr for 2 hours. The aluminium can was then sealed prior to hot isostatic pressing at 550° C., 30,000 psi for 2 hours.

The resultant composite had a density of 2.91 (g/cc) when measured by the water immersion technique. Both optical and scanning electron micrographs of the composite failed to display any porosity. An even distribution of SiC particles in the aluminium matrix was evident in these micrographs.

Mechanical test results on the above composite are summarised as follows:

Flexural strength=796.1 MPa

Youngs modulus=138 GPa (measured by dynamic mechanical analysis)

Fracture toughness $K_{1c}=18.9$ $MNm^{-1.5}$

Comparative Test (not according to the invention)

An identical powder mix to the above example was processed in the same manner, except that the powders were only blended and not high energy milled. The resultant composite had a density of 2.75 g/cc and a flexural strength of 190 MPa. Gross porosity was evident on visual examination.

We claim:

1. A method for preparing metal matrix composites comprising at least 40% v/v of a hard material selected from silicon carbides, silicon nitrides, silicon oxides, boron carbides, boron nitrides and boron oxides, and a lightweight component selected from aluminum, magnesium and alloys of either, the method comprising intimately mixing using a high energy milling technique a powder of the hard material and either aluminum or magnesium in its powder form to produce a uniform powder mixture and compacting the powder mixture at elevated temperatures.

2. A method according to claim 1 wherein the lightweight component is either a pure aluminium or magnesium metal or an alloy containing at least 70% by weight of aluminium or magnesium.

3. A method according to claim 1 wherein the composites are prepared from a powder of the hard material which contains less than about 20% by weight of fibres or whiskers of that material.

4. A method according to claim 1 wherein the powders of the hard material and aluminium, magnesium or alloys of either are intimately mixed in a high energy milling apparatus selected from a ball mill, a swing grinding mill (teamer mill) and an attritor mill.

5. A method according to claim 1 wherein the hard material powder has an average particle size of less than 50 microns and the powder of aluminium, magnesium or an alloy of either has an average particle size of less than 100 microns.

6. A method according to claim 1 wherein the powder mix contains the hard material in concentrations from 45% to 80% by volume.

7. A method according to claim 1 wherein the intimately mixed powder is uniformly compacted at elevated temperatures by hot isostatic pressing.

8. A method according to claim 7 wherein the hot isostatic pressing is used after degassing the system.

9. A method according to claim 8 wherein the degassed material is subjected to hot isostatic pressing at a temperature from 500°-560° C. and a pressure of at least 15,000 psi e.g. 30,000 psi for a duration of at least 1 hour.

* * * * *